US009900692B2

(12) United States Patent
McCoy et al.

(10) Patent No.: US 9,900,692 B2
(45) Date of Patent: Feb. 20, 2018

(54) SYSTEM AND METHOD FOR PLAYBACK IN A SPEAKER SYSTEM

(71) Applicants: SONY CORPORATION, Tokyo (JP); SONY NETWORK ENTERTAINMENT INTERNATIONAL LLC, Los Angeles, CA (US)

(72) Inventors: Charles McCoy, Coronado, CA (US); True Xiong, San Diego, CA (US); Francis Van Aeken, San Diego, CA (US)

(73) Assignee: SONY CORPORATION, Tokyo (JP)

( * ) Notice: Subject to any disclaimer, the term of this patent is extended or adjusted under 35 U.S.C. 154(b) by 58 days.

(21) Appl. No.: 14/326,633

(22) Filed: Jul. 9, 2014

(65) Prior Publication Data

US 2016/0014513 A1 Jan. 14, 2016

(51) Int. Cl.
*H04R 3/12* (2006.01)

(52) U.S. Cl.
CPC ..... *H04R 3/12* (2013.01); *H04R 2420/07* (2013.01)

(58) Field of Classification Search
USPC ..... 381/17, 79; 707/626; 370/338; 455/41.1–41.3, 556.1; 700/94
See application file for complete search history.

(56) References Cited

U.S. PATENT DOCUMENTS 7,747,338 B2 6/2010 Korhonen
8,233,648 B2 7/2012 Sorek et al.
8,548,381 B2 10/2013 Dua
2007/0141988 A1* 6/2007 Kuehnel ..... H04W 8/005 455/41.2
2007/0287420 A1 12/2007 Kirke
2008/0070516 A1 3/2008 Lee et al.
2010/0041330 A1 2/2010 Elg
2010/0284389 A1* 11/2010 Ramsay ..... G06F 17/30017 370/338
2011/0153043 A1* 6/2011 Ojala ..... G06F 3/0488 700/94

(Continued)

FOREIGN PATENT DOCUMENTS

EP 2463861 A1 6/2012
WO 2000041438 A1 7/2000

(Continued)

OTHER PUBLICATIONS

"Samsung Galaxy S4", "http://www.samsung.com/global/microsite/galaxys4/", Apr. 26, 2013.

(Continued)

*Primary Examiner* — Md S Elahee
(74) *Attorney, Agent, or Firm* — Chip Law Group

(57) ABSTRACT

Various aspects of a system and a method for playback in a wireless speaker system are disclosed herein. Each of a plurality of speakers in the system is operable to wirelessly receive one or more audio files from one or more audio source devices. The one or more audio source devices transmit the one or more audio files to at least one of the plurality of speakers in response to receipt of an acknowledgement of availability of at least one of the plurality of speakers.

18 Claims, 3 Drawing Sheets

(56) References Cited

U.S. PATENT DOCUMENTS

| | | | | |
|---|---|---|---|---|
| 2012/0308014 | A1* | 12/2012 | Pallapothu | G11B 27/034 381/17 |
| 2012/0310394 | A1 | 12/2012 | El-Hoiydi | |
| 2013/0273967 | A1* | 10/2013 | Dave | H04R 25/554 455/556.1 |
| 2013/0324031 | A1 | 12/2013 | Loureiro | |
| 2014/0279889 | A1* | 9/2014 | Luna | G06F 17/30575 707/626 |
| 2014/0328485 | A1* | 11/2014 | Saulters | H04S 7/301 381/17 |

FOREIGN PATENT DOCUMENTS

| | | | |
|---|---|---|---|
| WO | 2001039370 | A2 | 5/2001 |
| WO | 2007078254 | A2 | 7/2007 |
| WO | 2012117452 | A1 | 9/2012 |
| WO | 2013141768 | A1 | 9/2013 |
| WO | 2013142738 | A1 | 9/2013 |

OTHER PUBLICATIONS

Juan, "Stream ToMe", "http://www.applevis.com/apps/ios/music/streamtome", Jan. 17, 2014.

* cited by examiner

SYSTEM AND METHOD FOR PLAYBACK IN A SPEAKER SYSTEM

FIELD

Various embodiments of the disclosure relate to a speaker system. More specifically, various embodiments of the disclosure relate to a system and method for playback in a wireless speaker system.

BACKGROUND

Currently, users who play music on portable music players use the internal/built-in speaker within the portable music player. Even in a scenario where an external speaker system is available, the user may not be aware of the presence of the speaker system in the vicinity or of its availability. Moreover, when the user wishes to play an audio file on the speaker system, the user may connect the portable music player to speaker system through pairing. Thus, when there are multiple users in a room, each user has to separately pair their music player with the speaker system to playback their audio files. However, the speaker system may connect to and play audio files from a single music player at a time. Also, when the speaker system has multiple speakers, the user must identify an available speaker and connect his music player to the available speaker to play the audio file.

Further limitations and disadvantages of conventional and traditional approaches will become apparent to one of skill in the art, through comparison of described systems with some aspects of the present disclosure, as set forth in the remainder of the present application and with reference to the drawings.

SUMMARY

A system and method for playback are provided as shown in, and described in connection with at least one of the figures, as set forth more completely in the claims.

These and other features and advantages of the present disclosure may be appreciated from a review of the following detailed description of the present disclosure, along with the accompanying figures in which like reference numerals refer to like parts throughout.

DETAILED DESCRIPTION

Various implementations may be found in a system and method for playback in a wireless speaker system. Exemplary aspects of a method for playback include a speaker system with a plurality of speakers. In an embodiment, the plurality of speakers may receive one or more audio files from one or more audio source devices. The one or more audio source devices may transmit the one or more audio files wirelessly to at least one of the plurality of speakers in response to a receipt of an acknowledgement of availability of at least one of the plurality of speakers.

In an embodiment, each of the plurality of speakers may be operable to playback a plurality of audio files simultaneously. In an embodiment, each of the plurality of speakers may be operable to simultaneously playback a first frequency component of a first audio file and a second frequency component of a second audio file. The first audio file of the plurality of audio files may be received from one audio source device and the second audio file of the plurality of audio files may be received from another audio source device. In an embodiment, each speaker of the plurality of speakers may be operable to simultaneously playback a first frequency component of a first audio file and a second frequency component of a second audio file, from the same audio source device.

In an embodiment, the speaker system may broadcast a message that indicates availability of at least one of the plurality of speakers. The audio source devices may discover the availability of one of the plurality of speakers based on the broadcast message.

In an embodiment, the speaker system may receive a discovery request broadcast by at least one of the audio source devices to discover availability of at least one of the plurality of speakers. The speaker system may communicate the acknowledgement of availability of at least one of the plurality of speakers, based on the discovery request received from at least one of the audio source devices.

In an embodiment, the one or more audio files may be received by the plurality of speakers from the one or more audio source devices, without pairing of the plurality of speakers and the one or more audio source devices. In an embodiment, the one or more audio source devices may delay transmission of the one or more audio files, based on a distance of the at least one of the plurality of speakers from the one or more audio source devices.

In an embodiment, the speaker system may receive metadata associated with the one or more audio files. The metadata may comprise information of an audio file format of the one or more audio files. In an embodiment, at least one of the plurality of speakers may be an audio source device among the one or more audio source devices.

Figure 1:
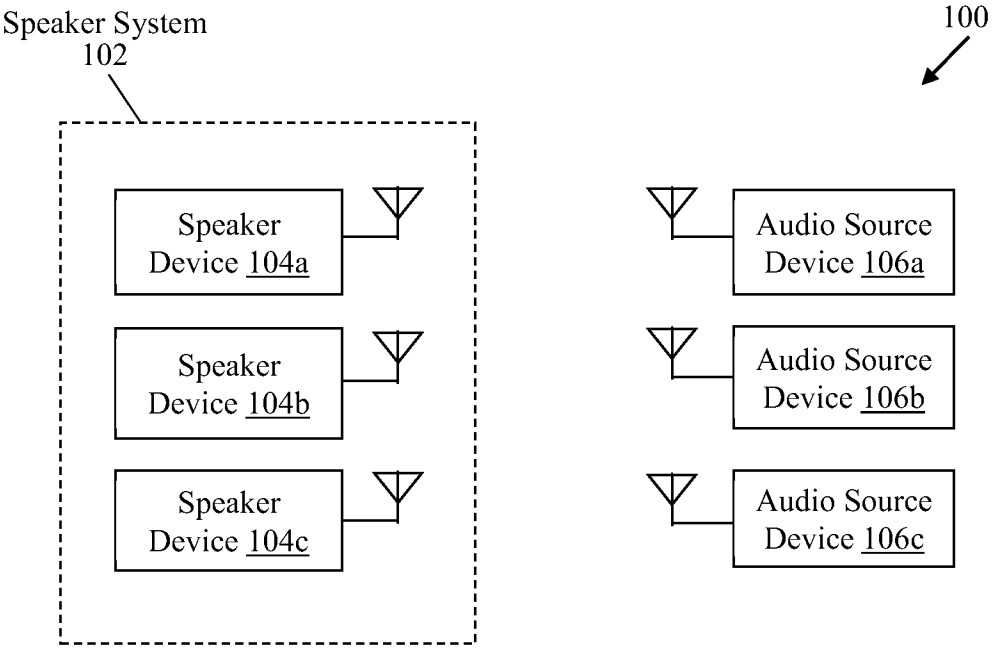
FIG. 1 is a block diagram illustrating an environment for playback in a wireless speaker system, in accordance with an embodiment of the disclosure.

FIG. 1 is a block diagram illustrating an environment for playback in a wireless speaker system, in accordance with an embodiment of the disclosure. With reference to FIG. 1, there is shown a network environment 100. The network environment 100 may comprise a speaker system 102, a plurality of speaker devices, such as speaker devices 104*a*, 104*b*, and 104*c*, and one or more audio source devices, such as audio source devices 106*a*, 106*b*, and 106*c*.

The speaker system 102 may comprise suitable logic, circuitry, interfaces, and/or code to playback an audio file and to communicate with the one or more audio source devices, such as audio source devices 106*a*, 106*b*, and 106*c*. The speaker system 102 may comprise a plurality of speaker devices 104*a*, 104*b*, and 104*c*. The speaker devices 104*a*, 104*b*, and 104*c* may comprise suitable logic, circuitry, interfaces, and/or code that may enable reproduction/playback of one or more audio files received from the audio source device 106. Examples of the speaker devices 104*a*, 104*b*, and 104*c* include, but are not limited to: a full range driver, a mid-range driver, a tweeter, a woofer, a sub-woofer, and/or other audio reproduction devices operable to reproduce frequency ranges within the audible frequency range. The plurality of speaker devices 104*a*-104*c* may communicate with the one or more audio source devices 106*a*-106*c* using wireless communication. The wireless communication may use any of a plurality of communication standards, protocols and technologies including, but not limited to: Global System for Mobile Communications (GSM), Enhanced Data GSM Environment (EDGE), wideband code division multiple access (W-CDMA), code division multiple access (CDMA), time division multiple access (TDMA), Bluetooth, Infrared (IR), Near Field Communication (NFC), Wireless Fidelity (Wi-Fi) (e.g., IEEE 802.11a, IEEE 802.11b, IEEE 802.11g and/or IEEE 802.11n), voice over Internet Protocol (VoIP), Wi-MAX, and/or the like. In an embodiment, the speaker devices 104*a*-104*c* may be display devices capable of playing back audio and video content.

The one or more audio source devices 106*a*-106*c* may comprise suitable logic, circuitry, interfaces, and/or code that may enable communication with the speaker devices 104*a*-104*c* of the speaker system 102. The audio source devices 106*a*-106*c* may include a portable media player for playback of audio/video data from a memory device, an internal memory, or from media, such as optical discs. The audio source devices 106*a*-106*c* may playback audio files of various formats, such as Moving Pictures Experts Group (MPEG), Audio Video Interleave (AVI), and/or RealVideo. The audio source devices 106*a*-106*c* may include various consumer electronics (CE) devices, a smartphone, and/or a tablet with memory for storing audio/video files and/or an application for decoding audio/video files. In an embodiment, the speaker system 102 and the audio source devices 106*a*-106*c* may form an ad-hoc network.

In operation, the one or more audio source devices 106*a*-106*c* may be configured to broadcast a discovery request to one or more of the plurality of speaker devices 104*a*-104*c*. In response to the received discovery request, the one or more of the plurality of the speaker devices 104*a*-104*c* may communicate an acknowledgement of availability for playback of audio files. In response to the receipt of the acknowledgement of availability, the audio source devices 106*a*-106*c* may transmit one or more audio files to one or more of the plurality of speaker devices 104*a*-104*c*. Each of the plurality of speaker devices 104*a*-104*c* is operable to wirelessly receive the one or more audio files from the one or more audio source devices 106*a*-106*c*.

In an embodiment, each of the plurality of speaker devices 104*a*-104*c* may be configured to broadcast a message that indicates their availability for audio playback. In an embodiment, the broadcast message may be a short wave radio signal. In response to receiving the broadcast message, the audio source device 106*a* may transmit one or more audio files to the speaker device 104*a*.

Figure 2:
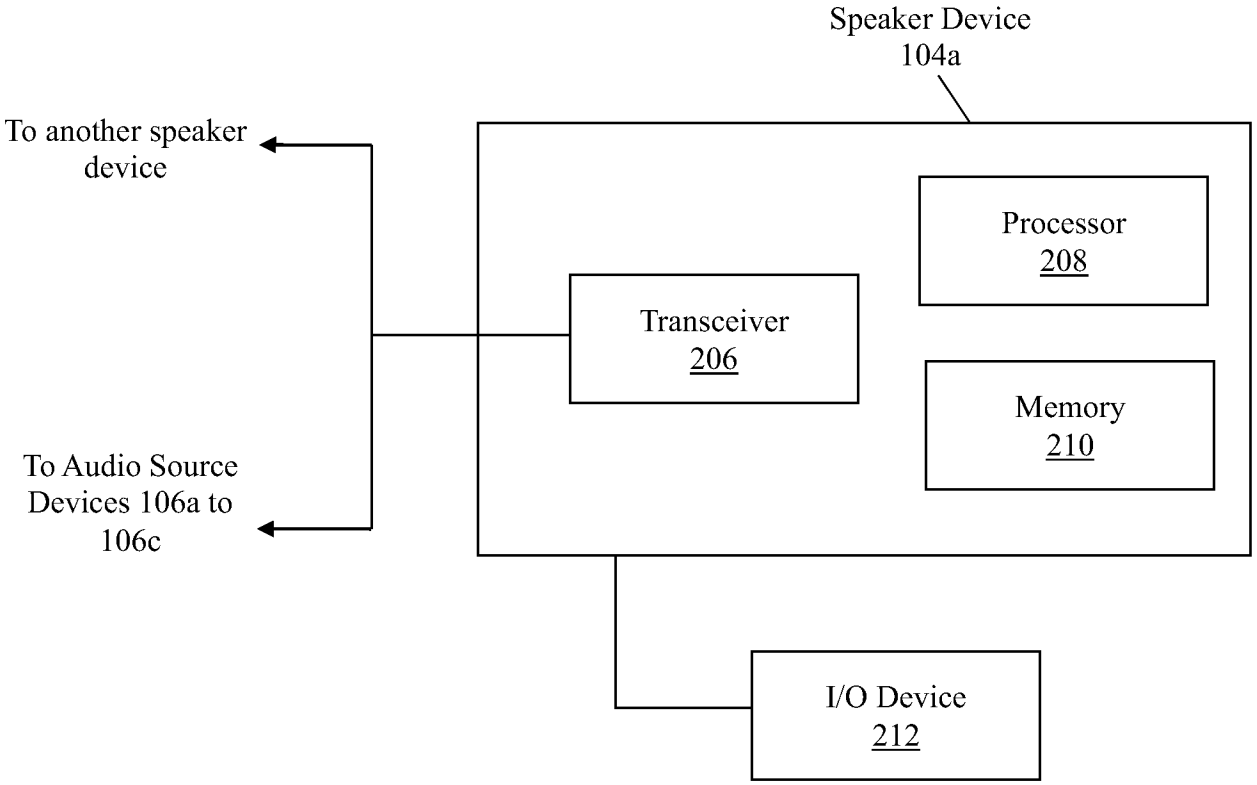
FIG. 2 is a block diagram illustrating a speaker device for playback in a wireless speaker system, in accordance with an embodiment of the disclosure.

FIG. 2 is a block diagram illustrating a speaker device for playback in a wireless speaker system, in accordance with an embodiment of the disclosure. FIG. 2 is explained in conjunction with elements from FIG. 1. With reference to FIG. 2, there is shown the speaker device 104*a*, which may comprise one or more processors, such as processor 208, a memory 210, transceiver 206 and an input/output (I/O) device 212.

The processor 208 may be communicatively coupled to the transceiver 206 and the memory 210. The processor 208 may receive input via the transceiver 206 and/or the memory 210. The processor 208 may be operable to process the received input to playback an audio file received from the audio source device 106*a*. The processor 208 may comprise suitable logic, circuitry, interfaces, and/or code that may be operable to execute a set of instructions stored in the memory 210. The processor 208 may be implemented based on a number of processor technologies known in the art. Examples of the processor 208 may be: an X86-based processor, a Reduced Instruction Set Computing (RISC) processor, an Application-Specific Integrated Circuit (ASIC) processor, a Complex Instruction Set Computing (CISC) processor, and/or any other processor.

The memory 210 may comprise suitable logic, circuitry, interfaces, and/or code that may be operable to store the received set of instructions. The memory 210 may be implemented based on, but not limited to: a Random Access Memory (RAM), a Read-Only Memory (ROM), a Hard Disk Drive (HDD), a storage server and/or a Secure Digital (SD) card. The memory 210 may be communicatively coupled to a secondary storage device, such as a hard disk or an external storage device (such as a compact disc (CD)). Such a communicative coupling may enable the memory to buffer audio/video content retrieved from the secondary storage device or the external storage device.

The transceiver 206 may comprise suitable logic, circuitry, interfaces, and/or code that may be operable to communicate with other speaker devices, such as speaker device 104*b* and speaker device 104*c* of the speaker system 102, and/or the one or more audio source devices 106*a*-106*c*. The transceiver 206 may implement known technologies for supporting wireless communication with other speaker devices, such as speaker device 104*b* and speaker device 104*c* of the speaker system 102, and the one or more audio source devices 106*a*-106*c*. The transceiver 206 may include, but is not limited to: an antenna, a radio frequency (RF) transceiver, one or more amplifiers, a tuner, one or more oscillators, a digital signal processor, a coder-decoder (CODEC) chipset, a subscriber identity module (SIM) card, and/or a memory. The transceiver 206 may communicate via wireless communication with networks, such as: the Internet, an Intranet and/or a wireless network, such as a cellular telephone network, a wireless local area network (LAN) and/or a metropolitan area network (MAN). The wireless communication may use any of a plurality of communication standards, protocols and technologies including, but not limited to: a Global System for Mobile Communications (GSM), Enhanced Data GSM Environment (EDGE), wideband code division multiple access (W-CDMA), code division multiple access (CDMA), time division multiple access (TDMA), Bluetooth, Wireless Fidelity (Wi-Fi) (e.g., IEEE 802.11a, IEEE 802.11b, IEEE 802.11g and/or IEEE 802.11n), voice over Internet Protocol (VoIP), Wi-MAX, a protocol for email, instant messaging, and/or Short Message Service (SMS).

The I/O device 212 may comprise various input and output devices that may be operable to receive an input or provide an output to a user. The I/O device 212 may comprise various input and output devices that may be operable to communicate with the processor 208. Examples of the input devices may include, but are not limited to: a keyboard, a mouse, a joystick, a touch screen, a microphone, a camera, a motion sensor, a light sensor, and/or a docking station. Examples of the output devices may include, but are not limited to, the speaker device 104*a* and/or a display screen.

In operation, the processor 208 may receive, via the transceiver 206, a discovery request for audio playback from the one or more audio source devices 106*a*-106*c*. The processor 208 may communicate an acknowledgement of availability in response to the received discovery request. The processor 208 may be operable to receive one or more audio files from the one or more audio source devices 106*a*-106*c* for playback.

In an embodiment, the processor 208 may broadcast a message indicating availability of one or more of the plurality of speaker devices 104*a*-104*c* for audio playback. In an embodiment, the processor 208 may broadcast the message at predetermined time intervals. In response to the broadcast message, the processor 208 may receive one or more audio files for playback from the one or more of the audio source devices 106*a*-106*c*.

In an embodiment, the processor 208 may be operable to playback the one or more audio files received from two or more audio source devices 106*a*-106*c* simultaneously. In an embodiment, the processor 208 may be configured to simultaneously play a first frequency component of a first audio file from the audio source device 106*a*, and a second frequency component of a second file from the audio source device 106*b*. The processor 208 may be configured to produce different sound effects by playback of different frequency components from different audio files. In an embodiment, the processor 208 may be operable to playback the one or more audio files received from a single audio source device 106*a*. The processor 208 may be configured to simultaneously play a first frequency component of a first audio file from the audio source device 106*a*, and a second frequency component of a second audio file sent from the same audio source device 106*a*.

In an embodiment, the speaker device 104*a* may be configured as a sub-woofer and may play the bass component of the received audio file. Simultaneously, the speaker device 104*b* may play the treble component of the received audio file. In an embodiment, in instances where the speaker device 104*a* receives a plurality of audio files from the same audio source device 106*a*, or different audio source devices, such as audio source device 106*b* and/or audio source device 106*c*, the speaker device 104*a* may play the bass component of one audio file and the treble component of another audio file. In an embodiment, in instances where the speaker device 104*a* receives a plurality of audio files from different audio source devices, such as audio source device 106*b* and/or audio source device 106*c*, the speaker device 104*a* may simultaneously play only the bass component (or any other frequency component within the audible frequency range), of each of the received audio files. In an embodiment, the speaker device 104*a* may combine different frequency components from the plurality of received audio files, and may playback a combined audio file. In an embodiment, the same audio file may be played back on the multiple speaker devices 104*a*-104*c* of the speaker system 102.

In an embodiment, two or more speaker devices 104*a*-104*c* may playback respective frequency components of the different audio files, simultaneously. In an embodiment, two or more speaker devices 104*a*-104*c* may playback different frequency components from the same audio file, simultaneously. In another embodiment, each of the received audio files may be played back independent of the other. In an embodiment, an order in which the received audio files are played back may be decided on a round-robin basis, first-come first serve basis, priority basis, payment basis, and/or the like.

In an embodiment, one or more audio source devices 106*a*-106*c* may each comprise a user interface (UI) to select from various types of speaker devices 104*a*-104*c* of the speaker system 102. The UI on the audio source device 106*a* may be used to select one or more of available speaker devices of the plurality of speaker devices 104*a*-104*c*. The UI may also be used to select audio files, or a specific frequency component of the audio files, to be played through the one or more selected speaker devices of the plurality of speaker devices 104*a*-104*c*. For example, such a UI may be used to select bass component of the selected audio file to be played back on a sub-woofer.

In an embodiment, the one or more audio source devices 106*a*-106*c* may check to determine if the plurality of speaker devices 104*a*-104*c* in the vicinity can receive audio over wireless fidelity (WiFi). Upon identification of the speaker devices 104*a*-104*c* that can receive audio files over WiFi, and selection of one or more identified speaker devices of the plurality of speaker devices 104*a*-104*c* using the UI, the audio source device 106*a* establishes WiFi connections to the speaker devices 104*a*-104*c*. The audio source device 106*a* may then stream the audio files to the one or more identified speaker devices 104*a*-104*c* over the WiFi connections.

In an embodiment, each of the plurality of speaker devices 104*a*-104*c* may comprise a directional microphone to detect ambient noise to be canceled. The directional microphone may be configured to neglect or not detect sound from the respective speaker device. The processor 208 of the speaker device 104*a* may be operable to generate an inverse signal of the noise that is detected and compensate for the frequency response curve of the microphone and the speaker device 104*a*. The inverse signal may then be amplified and played back by the speaker device 104*a*, to cancel the noise in the room. The processor 208 may be operable to apply equalization to compensate for any differences in sensitivity of the microphone or the speaker device 104*a*, at particular frequencies. In an embodiment, the directional microphone may be aimed at the speaker device 104*a* to calibrate the equalizer using white noise. The directional microphone may be added to an existing speaker system 102 to allow for the addition of noise cancellation functionality. In an embodiment, the equalization for the speaker system 102 may be factory set.

In an embodiment, the speaker system 102 may comprise an amplifier and speaker cables that carry both the microphone signal from the microphone and a signal from the amplifier. The speaker system 102 may act as a stand-alone noise cancellation system. The amplifier may be operable to amplify sound from the audio source devices 106*a*-106*c*.

In an embodiment, the speaker device 104*a* may use the directional microphone to play back two audio files simultaneously in such a manner that in one direction, the audio of only the first audio file is heard (by noise-cancelation of the audio of the second audio file), while in another direction, the audio of only the second audio file is heard (by noise-cancelation of the audio of the first audio file).

In an embodiment, the plurality of speaker devices 104*a*-104*c*, and the one or more audio source devices 106*a*-106*c*, do not need to pair or exchange a passkey to establish communication for reception of audio files. The speaker system 102 may establish wireless communication with a number of audio source devices 106*a*-106*c*.

To establish wireless communication, the one or more audio source devices 106*a*-106*c* may be operable to discover speaker devices available in a facility. In an embodiment, the discovery may be made when the one or more audio source devices 106*a*-106*c* broadcast a discovery request to the plurality of speaker devices 104*a*-104*c*. In an embodiment, the discovery may be made when the one or more audio source devices 106*a*-106*c* receive a message that indicates availability that is broadcast periodically by the plurality of speaker devices 104*a*-104*c* of the speaker system 102. Once the availability of a speaker device 104*a* is established, the one or more audio source devices 106*a*-106*c* may establish direct wireless communication with the available/discovered speaker device 104*a*. The one or more audio source devices 106*a*-106*c* and the speaker device 104*a* may then exchange capability information for interoperability. Examples of capability information may include, but are not limited to: information whether the speaker device 104*a* is a woofer/sub-woofer/tweeter, whether the speaker system 102 is a 7.1/5.1 surround sound system, information of the format in which the speaker system 102 and the one or more audio source devices 106*a*-106*c* play the audio files, such as Pulse Code Modulation (PCM) or Dolby Digital format, and/or the like. In an embodiment, the one or more audio source devices 106*a*-106*c* may transmit information of the audio file format of the audio files as metadata to the plurality of speaker devices 104*a*-104*c*.

In an embodiment, the one or more audio source devices 106*a*-106*c* may include a television (TV) or a home theater system. The TV/home theater system may be receiving programs with surround sound information, but may not be equipped with surround sound speakers. The TV/home theater system 106*a*-106*c* may wirelessly transmit the surround sound audio of the program being played to the plurality of speaker devices 104*a*-104*c* of the speaker system 102. In an embodiment, built-in speakers of a cell phone may be used in conjunction with the speaker devices 104*a*-104*c* of the speaker system 102, to produce a surround sound effect. The TV/home theater system 106*a*-106*c* may transmit the audio in accordance with a wireless transmission protocol. Examples of the wireless transmission protocol include, but are not limited to: Global System for Mobile Communications (GSM), Enhanced Data GSM Environment (EDGE), wideband code division multiple access (W-CDMA), code division multiple access (CDMA), time division multiple access (TDMA), Bluetooth, Wireless Fidelity (Wi-Fi) (e.g., IEEE 802.11a, IEEE 802.11b, IEEE 802.11g and/or IEEE 802.11n), voice over Internet Protocol (VoIP), Wi-MAX, a protocol for email, instant messaging, and/or Short Message Service (SMS).

In an embodiment, the one or more audio source devices 106*a*-106*c* may include a television (TV) or a home theater system. In an embodiment, the plurality of speaker devices 104*a*-104*c* may include a cell phone speaker. The built-in speakers of the TV/home theater system 106*a*-106*c* may be used in addition to the cell phone speakers for surround sound playback. The TV/home theater system 106*a*-106*c* may be configured to use a predefined number of cell phone speakers and/or the position information of the cell phone speakers to generate the surround sound effect. The TV/home theater system 106*a*-106*c* and the cell phones speakers comprise suitable logic, circuitry, interfaces, and/or code that may be operable to adjust the relative volume and timing of the audio being played. The TV/home theater system 106*a*-106*c* may be operable to provide calibration sounds to adjust the volume settings. In an embodiment, the cell phone speakers may augment the output of one or more surround sound speakers connected directly to the TV/home theater system 106*a*-106*c*. In an embodiment, the TV/home theater system 106*a*-106*c* may identify available cell phones in a location and send audio files to all the available cell phones throughout the location to form an ad hoc audio system.

In an embodiment, the plurality of speaker devices 104*a*-104*c* may include a cell phone speaker. The cell phone speaker 104*a* may be stereo synchronized to play the same audio transmitted by the one or more audio source devices 106*a*-106*c*. In instances where there are multiple cell phone speakers, one cell phone speaker may reproduce the left channel of the audio, and another cell phone speaker may reproduce the right channel of the audio to generate the stereo sound effect.

In an embodiment, the one or more audio source devices 106*a*-106*c* may include a cell phone and the speaker system 102 may include a car stereo system. In instances where there are multiple cell phones, one of the cell phones 106*a* may be used to control audio playback through a user interface (UI), such as fast forward, reverse and/or select another song from the catalog of music stored on another cell phone of the one or more audio source devices 106*b*-106*c*. Another cell phone, such as audio source device 106*b* or audio source device 106*c* may act as the source of audio being played. Any cell phone of the multiple cell phones may act as the audio source device 106*a* and the remaining cell phones, such as audio source device 106*b* and/or audio source device 106*c* may synchronize with the cell phone acting as the audio source device 106*a*. A mesh network between the cell phones and/or the car stereo system may be formed. A cell phone may also transmit the availability of an audio for sharing within the network.

In instances where the distance between the synchronized cell phones is known, the lag in audio playback due to the difference in positions of the cell phones may be compensated. A microphone may be used for determining the distance between the cell phones for lag compensation and synchronization. The microphone may be used to calibrate the timing of audio playback to synchronize the audio from one cell phone and the audio from other cell phones. The time of data transmission may be used to determine the distance for lag compensation and synchronization. Global positioning system (GPS) signals from the cell phones may be used to calculate the distance for compensating for distance lag.

In an embodiment, in instances where the audio source device 106*a* transmits an audio to more than one speaker device of the plurality of speaker devices 104*a*-104*c* of the speaker system 102, the audio source device 106*a* may delay the audio transmitted to a speaker device 104*a* placed near the audio source device 106*a* in comparison to the audio transmitted to a speaker device 104*b* and/or a speaker device 104*c* placed farther away. Hence, the sound produced by the speaker system 102 may be synchronized for all users/listeners near the audio source device 106*a* and users/listeners farther away from the audio source device 106*a*.

In an embodiment, the sound level of the speaker system 102 may match the sound level generated by the audio source device 106*a*. To match the sound level, the audio source device 106*a* may transmit information regarding the decibel level at which its hardware would produce a particular reference sound, such as white noise. This information may also be based on the current volume setting of the audio source device 106*a*. The speaker device 104*a* of the speaker system 102, which plays the audio received by the audio source device 106*a*, may set its volume level to match a decibel level of the received audio.

In an embodiment, each of plurality of speaker devices 104*a*-104*c* may be configured to act as both a speaker device and an audio source device. The plurality of speaker devices 104*a*-104*c* may simultaneously act as the speaker device and the audio source device.

Figure 3:
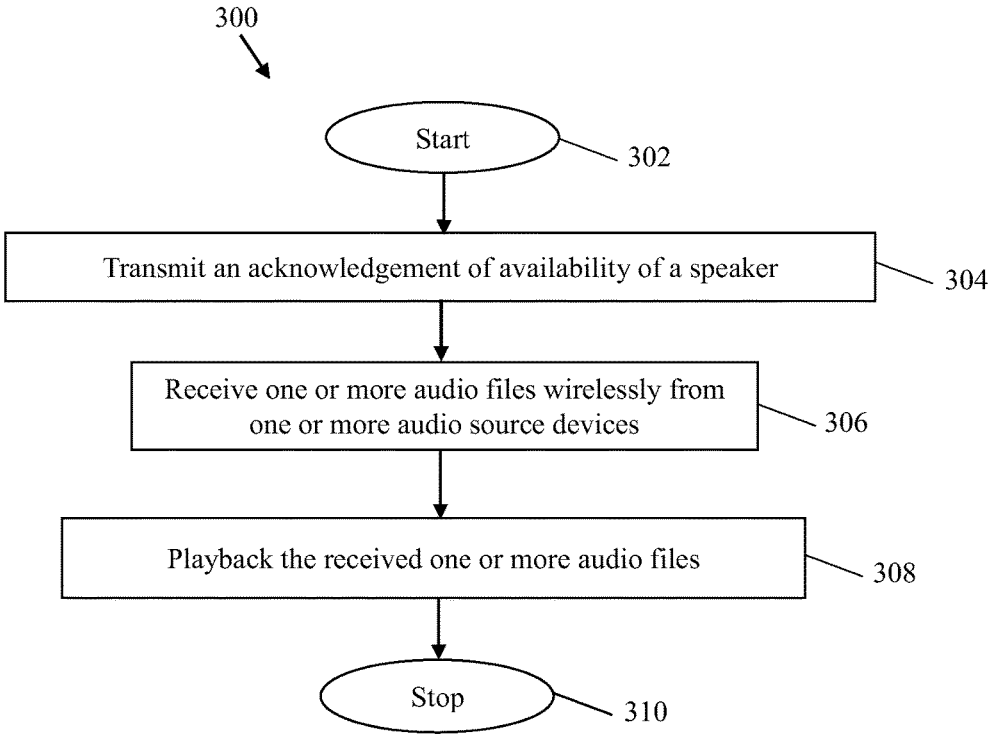
FIG. 3 is a flow chart illustrating exemplary steps for playback of audio files in a wireless speaker system, in accordance with an embodiment of the disclosure.

FIG. 3 is a flow chart illustrating exemplary steps for playback of audio files in a wireless speaker system, in accordance with an embodiment of the disclosure. With reference to FIG. 3, there is shown a flow chart 300. The flow chart 300 is described in conjunction with the diagrams of FIG. 1 and FIG. 2.

The method starts at step 302 and proceeds to step 304. At step 304, an acknowledgement of availability of a speaker device 104*a* is transmitted to the speaker devices 106*a*-106*c*. At step 306, one or more audio files are wirelessly received from one or more audio source devices 106*a*-106*c*. At step 308, the received one or more audio files may be played back by more than one speaker device 104*a*-104*c* simultaneously. The method ends at step 308.

In accordance with the present disclosure, a system for playback of audio files may comprise a plurality of speakers, hereinafter referred to as the speaker devices 104*a*-104*c* (FIG. 1). The speaker devices 104*a*-104*c* may be operable to receive one or more audio files from one or more audio source devices 106*a*-106*c* (FIG. 1). The one or more audio source devices 106*a*-106*c* may transmit the one or more audio files to at least one speaker device of the speaker devices 104*a*-104*c* in response to receiving an acknowledgement of availability of the speaker device 104*a*.

Various embodiments of the disclosure may provide a non-transitory computer readable medium and/or storage medium, and/or a non-transitory machine readable medium and/or storage medium having applicable mediums stored thereon, a machine code and/or a computer program having at least one code section executable by a machine and/or a computer for playback. The at least one code section may cause the machine and/or computer to perform the steps comprising receiving one or more audio files from one or more audio source devices 106*a*-106*c*. The one or more audio source devices 106*a*-106*c* may transmit the one or more audio files wirelessly to at least one of the plurality of speaker devices 104*a*-104*c*, in response to receiving an acknowledgement of availability of the at least one of the plurality of speaker devices 104*a*-104*c*.

Accordingly, the present disclosure may be realized in hardware, or a combination of hardware and software. The present disclosure may be realized in a centralized fashion in at least one computer system or in a distributed fashion where different elements may be spread across several interconnected computer systems. Any kind of computer system or other apparatus adapted for carrying out the methods described herein may be suited. A combination of hardware and software may be a general-purpose computer system with a computer program that, when being loaded and executed, may control the computer system such that it carries out the methods described herein. The present disclosure may be realized in hardware that comprises a portion of an integrated circuit that also performs other functions.

The present disclosure may also be embedded in a computer program product, which comprises all the features enabling the implementation of the methods described herein, and which when loaded in a computer system is able to carry out these methods. Computer program in the present context means any expression, in any language, code or notation, of a set of instructions intended to cause a system having an information processing capability to perform a particular function either directly or after either or both of the following: a) conversion to another language, code or notation; b) reproduction in a different material form.

While the present disclosure has been described with reference to certain embodiments, it will be understood by those skilled in the art that various changes may be made and equivalents may be substituted without departing from the scope of the present disclosure. In addition, many modifications may be made to adapt a particular situation or material to the teachings of the present disclosure without departing from its scope. Therefore, it is intended that the present disclosure not be limited to the particular embodiment disclosed, but that the present disclosure will include all embodiments falling within the scope of the appended claims.

What is claimed is:

1. A system for playback of one or more audio files, comprising:

a plurality of speakers, each of said plurality of speakers is configured to wirelessly receive said one or more audio files from one or more audio source devices, wherein at least one of said plurality of speakers is configured to directly broadcast a wireless message to said one or more audio source devices, wherein said wireless message indicates availability of said at least one of said plurality of speakers for play back of said one or more audio files, wherein said at least one of said plurality of speakers is configured to:

broadcast said wireless message based on a direct wireless discovery request from said one or more audio source devices to said plurality of speakers, generate a first inverse signal corresponding to a second audio file from said one or more audio files and a second inverse signal corresponding to a first audio file from said one or more audio files, wherein said first inverse signal and said second inverse signal are used for noise cancellation, and concurrently playback said first audio file from said one or more audio files in a first direction based on said noise cancellation that uses said first inverse signal, and said second audio file from said one or more audio files in a second direction based on said noise cancellation that uses said second inverse signal, and wherein said one or more audio source devices are configured to discover said availability of said at least one of said plurality of speakers based on said broadcasted wireless message.

2. The system of claim 1, wherein each of said plurality of speakers is further configured to playback a plurality of audio files concurrently.

3. The system of claim 1, wherein each of said plurality of speakers is further configured to:

playback a first frequency component of a third audio file from a first audio source device of said one or more audio source devices; and playback a second frequency component of a fourth audio file from a second audio source device of said one or more audio source devices, wherein said first frequency component and said second frequency component are played back concurrently.

4. The system of claim 1, wherein each of said plurality of speakers is further configured to:

playback a first frequency component of a third audio file; and playback a second frequency component of a fourth audio file, wherein said third audio file and said fourth audio file are transmitted from a same audio source device of said one or more audio source devices, and wherein said first frequency component and said second frequency component are played back concurrently.

5. The system of claim 1, wherein each of said plurality of speakers is further configured to receive said direct wireless discovery request broadcast from said one or more audio source devices to discover said availability of said at least one of said plurality of speakers.

6. The system of claim 1, wherein said one or more audio files are received by said plurality of speakers from said one or more audio source devices in absence of connection between said at least one of said plurality of speakers and said one or more audio source devices.

7. The system of claim 1, wherein said one or more audio source devices are further configured to delay transmission of said one or more audio files based on a distance of said at least one of said plurality of speakers from said one or more audio source devices.

8. The system of claim 1, wherein each of said plurality of speakers is further configured to receive metadata associated with said one or more audio files, and wherein said metadata comprises information of an audio file format of said one or more audio files.

9. The system of claim 1, wherein said at least one of said plurality of speakers is an audio source device among said one or more audio source devices.

10. The system of claim 1, wherein said one or more audio source devices are further configured to transmit said one or more audio files to said at least one of said plurality of speakers based on receipt of an acknowledgement of said availability of said at least one of said plurality of speakers.

11. A method for playback of one or more audio files, said method comprising:

in a speaker system comprising a plurality of speakers:

directly broadcasting a wireless message to one or more audio source devices, wherein said wireless message indicates availability of at least one of said plurality of speakers for playing back said one or more audio files, wherein said wireless message is broadcasted based on a direct wireless discovery request broadcast from said one or more audio source devices to said plurality of speakers, and wherein said one or more audio source devices are configured to discover said availability of said at least one of said plurality of speakers based on said broadcasted wireless message;

receiving said one or more audio files from said one or more audio source devices based on said broadcasted wireless message;

generating a first inverse signal corresponding to a second audio file from said one or more audio files and a second inverse signal corresponding to a first audio file from said one or more audio files, wherein said first inverse signal and said second inverse signal are used for noise cancellation; and concurrently playing back said first audio file from said one or more audio files in a first direction based on said noise cancellation that uses said first inverse signal, and said second audio file from said one or more audio files in a second direction based on said noise cancellation that uses said second inverse signal, by said at least one of said plurality of speakers.

12. The method of claim 11, further comprising:

playing back a first frequency component of a third audio file from a first audio source device of said one or more audio source devices; and playing back a second frequency component of a fourth audio file from a second audio source device of said one or more audio source devices, wherein said first frequency component and said second frequency component are played back concurrently.

13. The method of claim 11, further comprising receiving said direct wireless discovery request broadcast from said one or more audio source devices for discovering said availability of said at least one of said plurality of speakers.

14. The method of claim 11, further comprising delaying transmission of said one or more audio files based on a distance of said at least one of said plurality of speakers from said one or more audio source devices.

15. The method of claim 11, further comprising receiving metadata associated with said one or more audio files, wherein said metadata comprises information of an audio file format of said one or more audio files.

16. The method of claim 11, wherein said at least one of said plurality of speakers is an audio source device among said one or more audio source devices.

17. A speaker, comprising:

one or more circuits, in a transceiver, wherein said one or more circuits are configured to:

directly broadcast a wireless message to one or more audio source devices, wherein said wireless message indicates availability of said speaker for playing back one or more audio files, wherein said wireless message is broadcasted based on a direct wireless discovery request broadcast from said one or more audio source devices to said speaker, and wherein said one or more audio source devices are configured to discover said availability of said speaker based on said broadcasted wireless message;

receive said one or more audio files from said one or more audio source devices based on said broadcasted wireless message;

generate a first inverse signal corresponding to a second audio file from said one or more audio files and a second inverse signal corresponding to a first audio file from said one or more audio files, said first inverse signal and said second inverse signal are used for noise cancellation; and concurrently playback said first audio file from said one or more audio files in a first direction based on said noise cancellation that uses said first inverse signal, and said second audio file from said one or more audio files in a second direction based on said noise cancellation that uses said second inverse signal.

18. The speaker of claim 17, wherein said speaker is configured to:

receive a third audio file from a first audio source device of said one or more audio source devices, and receive a fourth audio file from a second audio source device of said one or more audio source devices, wherein an order to play said third audio file and said fourth audio file is based on round-robin scheduling or queuing.

* * * * *